US010672224B2

(12) United States Patent
Harris et al.

(10) Patent No.: US 10,672,224 B2
(45) Date of Patent: Jun. 2, 2020

(54) APPARATUS, SYSTEM AND METHOD FOR UTILIZING A SECONDARY CONTROLLER FOR MULTIPLE GAME PLAY AND TRACKING CREDITS

(71) Applicant: Ronnie Harris, Las Vegas, NV (US)

(72) Inventors: Ronnie Harris, Las Vegas, NV (US); Robert DelRossi, Las Vegas, NV (US); Erica Frohm, Chicago, IL (US); Janae Hoover, Las Vegas, NV (US); David Hatton, Ada, OK (US); Charles Lombardo, Henderson, NV (US)

(73) Assignee: Ronnie Harris, Las Vegas, NV (US)

( * ) Notice: Subject to any disclaimer, the term of this patent is extended or adjusted under 35 U.S.C. 154(b) by 885 days.

(21) Appl. No.: 14/738,441

(22) Filed: Jun. 12, 2015

(65) Prior Publication Data

US 2015/0364003 A1 Dec. 17, 2015

Related U.S. Application Data

(60) Provisional application No. 62/011,428, filed on Jun. 12, 2014.

(51) Int. Cl.
*G07F 17/32* (2006.01)

(52) U.S. Cl.
CPC ..... *G07F 17/3225* (2013.01); *G07F 17/3244* (2013.01)

(58) Field of Classification Search
None
See application file for complete search history.

(56) References Cited

U.S. PATENT DOCUMENTS

| | | | | |
|---|---|---|---|---|
| 5,971,271 | A | 10/1999 | Wynn | |
| 6,146,271 | A * | 11/2000 | Kadlic | G07F 17/32 273/292 |
| 6,409,602 | B1 | 6/2002 | Wiltshire | |
| 7,189,161 | B1 | 3/2007 | Wiltshire | |
| 7,322,886 | B2 | 1/2008 | Manz | |
| 7,335,106 | B2 | 2/2008 | Johnson | |
| 7,641,552 | B2 | 1/2010 | Manz | |
| 7,744,462 | B2 | 6/2010 | Grav | |
| 7,758,418 | B2 | 7/2010 | Manz | |
| 7,828,658 | B2 | 11/2010 | Manz | |
| 7,837,560 | B2 | 11/2010 | Wiltshire | |
| 7,892,098 | B2 | 2/2011 | Nguyen | |
| 7,901,294 | B2 | 3/2011 | Walker | |
| 8,083,592 | B2 | 12/2011 | Wells | |
| 8,088,014 | B2 | 1/2012 | Wells | |
| 8,133,102 | B2 | 3/2012 | Dabrowski | |
| 8,353,765 | B2 | 1/2013 | Goldschmidt | |
| 8,371,937 | B2 | 2/2013 | Larsen | |
| 8,388,424 | B2 | 3/2013 | Dabrowski | |
| 8,414,372 | B2 | 4/2013 | Cannon | |

(Continued)

*Primary Examiner* — Jason Skaarup
(74) *Attorney, Agent, or Firm* — Crowe & Dunlevy, P.C.

(57) ABSTRACT

An improved apparatus, system and method for presenting multiple systems, games, and/or services on a common Player Interface, for example, any component or components of a gaming system, including an electronic or technologic aid—including, but not limited to terminals, player stations, handhelds, fixed units, etc.—that directly enables player interaction in a game, and create, monitor, translate, record, and communicate data such as accounting information, player transactions, etc.

46 Claims, 4 Drawing Sheets

(56) References Cited

U.S. PATENT DOCUMENTS

| | | | | |
|---|---|---|---|---|
| 8,460,082 | B2 | 6/2013 | Harris | |
| 8,496,523 | B2 | 7/2013 | Bytnar | |
| 8,506,386 | B2 | 8/2013 | Harris | |
| 8,512,120 | B2 | 8/2013 | Nelson | |
| 8,512,144 | B2 | 8/2013 | Johnson | |
| 8,529,328 | B2 | 9/2013 | Tarantino | |
| 8,529,342 | B2 | 9/2013 | Tarantino | |
| 8,549,276 | B2 | 10/2013 | Chen | |
| 8,585,479 | B2 | 11/2013 | Ryan | |
| 8,628,404 | B2 | 1/2014 | Harris | |
| 8,662,985 | B2 | 3/2014 | Johnson | |
| 8,696,449 | B2 | 4/2014 | Larsen | |
| 8,721,449 | B2 | 5/2014 | Johnson | |
| 8,784,213 | B2 | 7/2014 | Johnson | |
| 8,900,057 | B2 | 12/2014 | Johnson | |
| 8,915,783 | B2 | 12/2014 | Johnson | |
| 8,932,125 | B1 | 1/2015 | Harris | |
| 8,932,130 | B2 | 1/2015 | Tarantino | |
| 8,956,213 | B2 | 2/2015 | Manz | |
| 9,105,155 | B1 | 8/2015 | Harris | |
| 9,292,998 | B2 | 3/2016 | Manz | |
| 9,342,954 | B1 | 5/2016 | Harris | |
| 9,564,004 | B2 | 2/2017 | Mosser | |
| 9,613,419 | B2 | 4/2017 | Cunningham | |
| 9,619,966 | B2 | 4/2017 | Harris | |
| 9,836,913 | B2 | 12/2017 | Manz | |
| 2002/0183105 | A1* | 12/2002 | Cannon | G07F 17/32 463/16 |
| 2006/0063581 | A1 | 3/2006 | Harris | |
| 2007/0004519 | A1 | 1/2007 | Mosser | |
| 2007/0155469 | A1 | 7/2007 | Liddle | |
| 2007/0202941 | A1* | 8/2007 | Miltenberger | G07F 17/32 463/25 |
| 2008/0058056 | A1 | 3/2008 | Mosser | |
| 2009/0104954 | A1* | 4/2009 | Weber | G07F 17/32 463/1 |
| 2009/0156296 | A1 | 6/2009 | Manz | |
| 2009/0209350 | A1* | 8/2009 | Kelly | G07F 17/32 463/42 |
| 2010/0197385 | A1* | 8/2010 | Aoki | G07F 17/32 463/27 |
| 2010/0210353 | A1* | 8/2010 | Gagner | G07F 17/32 463/25 |
| 2011/0009188 | A1* | 1/2011 | Adiraju | G07F 17/32 463/25 |
| 2011/0028203 | A1* | 2/2011 | Agarwal | G07F 17/3211 463/20 |
| 2011/0118020 | A1 | 5/2011 | Manz | |
| 2011/0218027 | A1 | 9/2011 | Manz | |
| 2012/0015718 | A1 | 1/2012 | Lombardo | |
| 2013/0130766 | A1 | 5/2013 | Harris | |
| 2014/0162783 | A1* | 6/2014 | Frattinger | G07F 17/323 463/31 |
| 2014/0194181 | A1 | 7/2014 | Harris | |
| 2014/0256400 | A1 | 9/2014 | Harris | |
| 2015/0364003 | A1 | 12/2015 | Harris | |
| 2016/0158194 | A1 | 6/2016 | Harris | |
| 2016/0232738 | A1 | 8/2016 | Daly | |
| 2017/0372559 | A1 | 12/2017 | Harris | |
| 2018/0158275 | A1 | 6/2018 | Manz | |

* cited by examiner

APPARATUS, SYSTEM AND METHOD FOR UTILIZING A SECONDARY CONTROLLER FOR MULTIPLE GAME PLAY AND TRACKING CREDITS

PRIORITY STATEMENT

This application claims the benefit of U.S. Provisional Application 62/011,428 filed Jun. 12, 2014.

FIELD OF THE INVENTION

The present disclosure relates to an apparatus, system and method for integrating the functionality of two or more systems into an aggregated system. More particularly, the present disclosure relates to an apparatus, system and method for presenting multiple systems, games, and/or services on a common Player Interface, for example, any component or components of a gaming system, including an electronic or technologic aid—including, but not limited to terminals, player stations, handhelds, fixed units, etc.—that directly enables player interaction in a game (hereafter referred to as Player Interface), and create, monitor, translate, record, and communicate data such as accounting information, player transactions, etc.

BACKGROUND OF THE INVENTION

Some gaming machines offer the player the opportunity to play a single game. Other gaming machines offer the opportunity to play multiple instances of a single game or several games at the same time. Still other gaming machines may offer the opportunity for the player to choose one or more of multiple games offered on a menu of games. These games are offered on a common platform running on the same processor board and/or system. These games are programmed specifically for compatibility with the common platform and system. There is, however, no system that allows multiple independent or dependent systems or platforms, operating on independent processor boards or as independent services on the same processor board with no knowledge of the other games or applications running alongside, that presents the multiple independent games and applications to a player on a single Player Interface, allowing the player to make purchases and other transactions using a single credit balance while managing the aggregation of transactions and accounting for the combined systems.

One of the challenges in offering the player access to multiple systems simultaneously on a single interface is that, among other issues, no system or method exists for providing a single player balance for all transactions across those independent systems. The present disclosure is an apparatus, system and method using a controlling framework, such as a transaction controller, and a meter, such as a master balance meter (combined or collectively referred to as the "Transaction Manager" herein) for aggregating the transactions of the independent systems as a single player total balance while also providing segregated and the aggregated resulting data for use by system providers and/or casino operators. The present disclosure describes solutions for each of the shortcomings (and others) in the prior art systems.

SUMMARY OF THE INVENTION

The present disclosure is an apparatus, system and method(s) being utilized as a controlling framework that is installed or included in an independent system, that allows at least one additional game play and/or other services (collectively Applications) hosted from one or more independent or dependent systems or service providers using the Player Interface of the independent system. In a preferred embodiment, the present disclosure is an apparatus, system and method, herein referred to for convenience as System 2, which can be manufactured, installed, upgraded, etc. in or into an independent system, herein referred to for convenience as System 1, allowing System 1 to provide additional game play and/or services (Applications) offered from one or more systems or service providers, proper accounting, transmission of information and/or other functionality and services not performed by System 1 alone. For clarity purposes, System 2 can be added on to System 1 through hardware or software as an upgrade; or System 2 can be included in the original manufacturing of System 1, with the same resulting functionality as described herein; and System 2 may embody multiple independent or dependent systems that may include one or multiple Applications. For further convenience, the description below will pertain to System 2 as an upgrade to System 1 to provide the associated functionality.

In the preferred embodiment, the presentation of information generated by System 1 may share one or more display devices (video display, touchscreen, etc.) with presentation elements of System 2. The information from both systems is presented on the Player Interface of System 1. The present disclosure allows this functionality to be incorporated with other manufacturers' gaming cabinet or to be included in the original design of the cabinet. In one embodiment, System 1 is a Class III game and System 2 is a Class II game, as defined by the Indian Gaming Regulatory Act of 1988.

As described above, the present disclosure includes either hardware, software or a combination of both to make available a component called a Transaction Manager. In accordance with the preferred embodiment of the present disclosure, the Transaction Manager maintains one balance for the combined player transactions of System 1 and System 2. This arrangement allows the display to the player of one master balance resulting from all transactions at that Player Interface. The Transaction Manager is used for all transactions in both systems in the preferred embodiment, including purchases and wins, and maintains records pertaining to these activities.

The Transaction Manager can assign ownership of the master balance to one of the systems. All credit transactions initiated are applied to the master balance. In one embodiment, the master balance resides on System 1 and is displayed to the player on the Player Interface. In this embodiment when the player wishes to make a purchase from System 2, the Transaction Manager transfers the amount from System 1 to System 2, thereby reducing the master balance. The transferred amount is then used to purchase a game or service on System 2. Credits won, acquired, or refunded on System 2 are transferred to System 1 by the Transaction Manager, thereby increasing the player's total balance. The Transaction Manager of the present disclosure is designed to ensure that transfers among independent systems do not conflict resulting in an accurate player's total balance.

If any problems occur preventing the Transaction Manager from transferring the amounts, the amount may be transferred upon resolution of the original problem. If the original problem cannot be resolved, the amount can be paid by using an optional hand pay feature or other features of the systems.

The Transaction Manager can provide data regarding the master balance and related transactions to one or more systems for the purpose of accounting and other operational data. The Transaction Manager can provide both segregated per Application and/or System as well as provide the aggregate for all Applications and/or Systems operating on the Player Interface. This data is commonly used to audit accounting, validate purchase and win records, analyze performance, among other tasks key to operations.

As described herein, the present disclosure can be a feature of or on virtually any gaming machine on any platform. The present disclosure can be used on a single gaming machine or on multiple gaming machines connected to each other or through a communication network to other machines, and/or to a main server or to the Internet or any combination of connections/networks. Other objectives and advantages of the present disclosure will become apparent to one having ordinary skill in the art after reading the specification in light of the drawing figures, however, the spirit and scope of the present disclosure should not be limited to the description of the embodiments contained herein.

DETAILED DESCRIPTION OF EMBODIMENTS OF THE INVENTION

Figure 1:
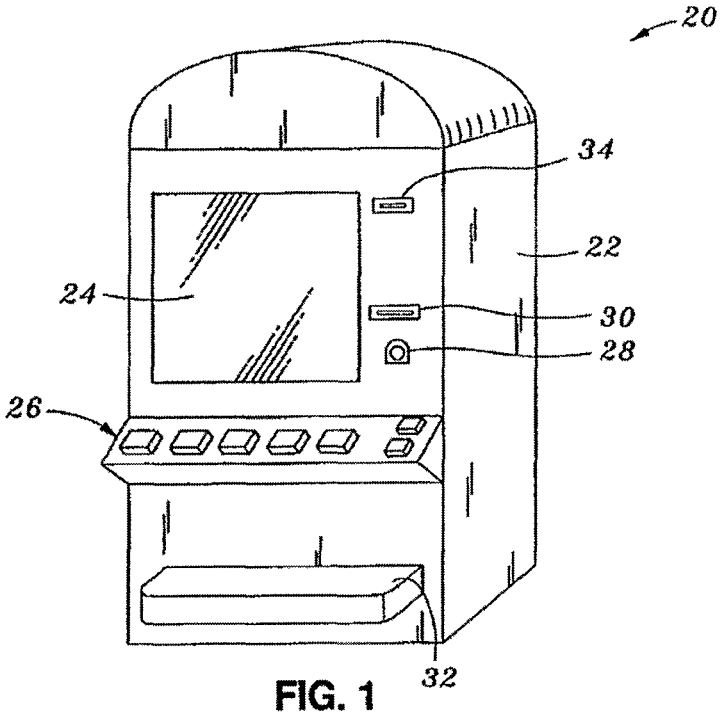
FIG. 1 illustrates a Player Interface in accordance with one embodiment of the invention.

The present disclosure relates to an apparatus, system and method for integrating the functionality of two or more systems into an ostensibly aggregated system via a controlling framework. More particularly, the present disclosure relates to an apparatus, system and method for presenting multiple systems, games, and/or services on a common Player Interface, for example, any component or components of a gaming system, including an electronic or technologic aid—including, but not limited to terminals, gaming machines, player stations, handhelds, fixed units, etc. (hereafter referred to as Player Interfaces)—that directly enables player interaction in a game and/or service, and create, monitor, translate, record, and communicate data such as game results, accounting information, player transactions, etc.

The present disclosure further comprises the hardware and/or software to allow, for example, the multiple systems to be displayed on an existing Player Interface or on a new gaming device design that includes a Player Interface, and may include protocol for monitoring, aggregating, organizing, tracking and transmitting information about the activity for the multiple games and/or services. As an example, the present disclosure allows for a player to play a game on one system, with an option for that player to play one or more additional and usually different game from other systems on the same display or Player Interface, all while the apparatus or system keeps track of the different game plays related accounting data and the different credit or monetary transactions from each game or service transaction.

In the following disclosure, numerous specific details are set forth in order to provide a more thorough description of the present disclosure. It will be apparent, however, to one skilled in the art, that the present disclosure may be practiced without these specific details. In other instances, well-known features have not been described in detail so as not to obscure the disclosure.

The preferred embodiment of the present disclosure is a method of playing or displaying a game or service from one system on the Player Interface, and allowing the player to purchase services or play a game (Applications) from one or more other systems on the same Player Interface, either by reducing the size of the first game displayed while the additional Applications are being used, or having areas on the display that are dedicated, fully or in part, for either the first game or the additional Applications. In the preferred embodiment, the first game is a Class III game and at least one of the additional Applications presents a Class II game, as understood by those having ordinary skill in the art. Also in the preferred embodiment, the player may receive rewards that may be non-monetary from another, independent, dependent, or integrated systems, such as free hotel rooms or meals, and the rewards provided may be in addition to any credits or wins from the primary or secondary game play, thereby increasing the player's perception of winning odds when playing that particular Player Interface.

The present disclosure includes either hardware, software or a combination of both to make available a component called Transaction Manager. In accordance with the preferred embodiment of the present disclosure, the Transaction Manager uses a transaction controller and a master balance to provide one master balance for the combined player transactions of the primary game (System 1), the secondary game (System 2), and all other systems making transactions with the master balance. This arrangement allows the player to have one master balance resulting from all transactions at that Player Interface. The Transaction Manager is used for transactions in all combined systems, including purchases and wins.

In one embodiment, the master balance is configured such that when a player inserts currency or a voucher into a bill acceptor or other playable credits on the Player Interface or system, the credits are added to the master balance. When the player wishes to make a purchase to, for instance, play a secondary game, the credits are transferred to the secondary game in accordance with the present disclosure. The transferred amount is then used to purchase the secondary game, which the player can then play. If any credits are won or refunded from the secondary game, the credits are transferred to back to the master balance.

If any problems occur preventing the Transaction Manager from transferring the credits, the credits will transfer upon resolution of the original problem. If the original problem is unresolvable, the credits can be paid using an optional hand pay feature or other features of the systems.

The master balance of the present disclosure allows the primary game, for example a game on System 1, to also update the master balance as it would normally update the credit balance, and Transaction Manager of the present disclosure will acknowledge the state of the primary game to ensure that transfer of credits to and from the secondary game, for example a game or service (Applications) on System 2, will be timed appropriately with other primary game activity.

The various apparatus, systems or methods of the disclosure, including System 1 and System 2, may be presented on or by a Player Interface, or system as described herein. The gaming system may have a variety of configurations, with one embodiment of a gaming system being illustrated in FIG. 1.

FIG. 1 shows an example of a Player Interface commonly known as gaming device or machine 20 that includes a housing 22 containing or supporting various components. The Player Interface 20 is, either alone or in combination with other devices, preferably configured to present a game on a display 24, such as a game of the present disclosure. It will be appreciated that the housing 22 may have a variety of shapes and configurations, such as an "upright," "bar-top" or "slant" style gaming machine, which configurations are well known in the industry, but may also include handhelds and other Player Interfaces now known or later developed.

As shown, the gaming machine 20 includes means for displaying symbols or indicia utilized in the play or presentation of the games, rewards, and/or services. In a preferred embodiment, the Player Interface 20 is configured as a "video" type device, in which information is displayed on at least one display 24. In a preferred embodiment, the display 24 is a video display which may include touchscreen functionality. The display 24 may be of a variety of types now known or later developed, such as DLP, CRT, plasma, LCD or others.

The Player Interface 20 preferably includes one or more player inputs which permit the player to interact with the Player Interface 20. In the embodiment illustrated, the Player Interface 20 includes a plurality of push-buttons 26. The function to which each button is linked may vary, depending at least in part upon the particular Applications which the Player Interface 20 is presenting or is configured to present. For example, as described below, the buttons 26 might include a "play" button, a "bet one" button, a "bet max" button, and a "cash out" button, among others. These buttons may also be configured to change functions depending on the Applications being used.

A wide variety of other inputs may be provided, varying both in form and function. For example, in one embodiment, the display may be configured as a "touch screen" type display. Other inputs, such as a rotatable arm, joysticks, keyboards or keypads, or other inputs may be provided. Each input preferably provides input, such as by way of an electrical, cabled, or wireless signal, to the Player Interface. In that manner, game play and services are interactive.

In one embodiment, the Player Interface 20 is configured to present a game only upon a player placing a bet, wager, or other payment. Thus, the Player Interface 20 may include means for accepting credit or value, and preferably, monetary value. As illustrated, the Player Interface 20 may include a coin acceptor 28. The coin acceptor 28 may be configured to accept coins of one or more denominations. A coin sorter, coin hopper and other coin holding and processing devices may be located in the housing 22 of the Player Interface 20.

The Player Interface 20 may also or alternatively include a bill validator 30. The bill validator 30 may be configured to accept paper money of one or more denominations. A bill stacker and other bill processing and storage devices may be located in the housing 22 of the Player Interface 20.

The Player Interface 20 may also or alternatively include a ticket reader, smart card, credit card or other media acceptor/reader. Such devices may be utilized to obtain information regarding value, such as credit card account information or bar-coded ticket value. In one embodiment, the ticket reader may be combined with the bill validator 30.

When value is provided to the Player Interface 20, the Player Interface 20 may be configured to display information regarding the provided value, such as in the form of "credit" information. This information may be displayed, for example, on a display of the Player Interface or one associated therewith. The player may utilize one or more of these inputs to place a wager, bet or provide payment to play one or multiple games or purchase items or services. For example, a player may depress a "bet one" or "bet max" button to bet or wager one or more credits.

In one embodiment, the Player Interface 20 is configured to award winnings for winning outcomes of games played. The winnings may be paid or provided to the player in a variety of manners. In one embodiment, awards may be indicated in the form of credits. Thus, when a player wins, the total number of credits is increased, and the increased amount may be displayed to the player as the master balance. The player may utilize the awarded credits to play future games or make other purchases.

In another embodiment, the player may be awarded money, or may convert credits to money. As illustrated, the Player Interface 20 may include a coin tray 32 into which coins may be dispensed. The coins may represent a specific award. Alternatively, the player may utilize a "cash out" button or input and be paid the value of their cashable credits in the form of coins. Other forms of payment may be provided, such as by issuance of a ticket which represents value. As illustrated, the Player Interface 20 includes a ticket printer 34 for printing and dispensing a medium bearing information regarding value or a coin hopper 34 for dispensing coins. Regardless of the type or amount of award, the present invention provides tracking and aggregating functionality along with transmission capabilities so that any credits pertaining to the different games played and other transactions made using the master balance can be monitored, tracked, accounted for and the information pertaining thereto can be transmitted to one or more systems for monitoring and accounting purposes.

The present disclosure further provides hardware and/or software for controlling the operation of the Player Interface 20, such as the content displayed by the display 24. In one embodiment as detailed below, controlling the operation comprises a transaction controller or gaming controller. The Transaction Manager may be configured to track game credits (including value provided to the Player Interface and bets placed and/or purchases made), generate and/or display game symbols or indicia. In one embodiment, the Transaction Manager includes a processor and a memory. The memory stores software which is executed by the processor. In one embodiment, the Transaction Manager is located inside of the housing 22 of the Player Interface 20, or associated cabinetry.

The Player Interface 20 illustrated and described is just one embodiment of a device which may be used to present a game or other Application in accordance with the disclosure. Other devices may be utilized. For example, the Player Interface 20 may also comprise a computing device, such as a laptop, desktop, or other computer. Application information may be transmitted via a communication link to a remote player. The communication link may include, for example, the Internet. The information may be utilized by the remote player's computer, such as by displaying Application information on an associated screen. A player may provide input via a keyboard, mouse or other input device.

As described herein, in the preferred embodiment, the Player Interface 20 is configured to present a Class III game as the primary game, and at least one Class II game. With this arrangement, winnings from the Class II game may seemingly increase the odds that the player encounters when playing that particular Player Interface.

Figure 2:
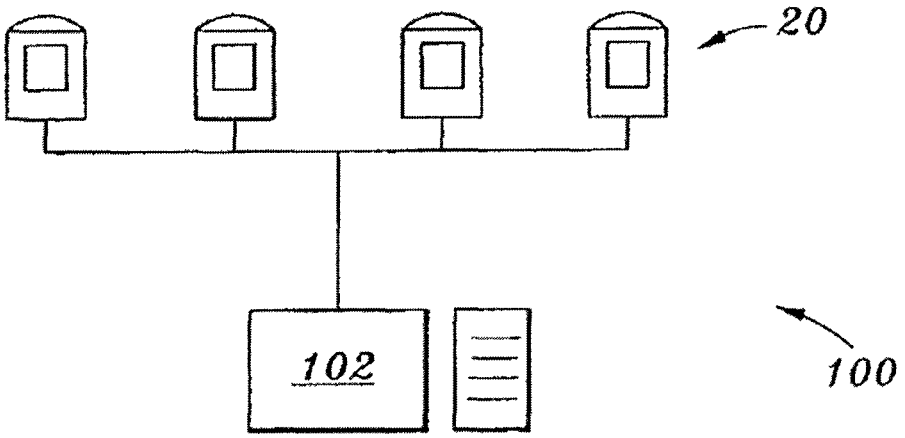
FIG. 2 illustrates a system in accordance with one embodiment of the invention; the system including one or more Player Interfaces.

FIG. 2 illustrates an embodiment in which a gaming system 100 includes at least two Player Interfaces 20. In one embodiment, the operation of each Player Interface 20 is controlled in whole or in part from a remote location, such as a remote server 102. For example, game and/or Application data may be generated remotely and be transmitted to the Player Interface 20 for display. The game data may then be downloaded to the Player Interface 20 via a wired or wireless communication link, or in other ways known in the industry or may later be conceived.

In such a configuration, when a player wishes to play a game at a Player Interface 20, the Player Interface 20 sends a signal to the server 102. The server 102 may create game data which is transmitted to the Player Interface 20 for use by the Player Interface 20 in presenting the game. Such a configuration of a distributed gaming system are well known.

The Player Interfaces 20 and the gaming system 100 may have a variety of other embodiments. For example, the Player Interfaces 20 might comprise computing devices and the system might include a LAN, WAN, dedicated communication links, and even include the Internet. For example, the game might be presented to a plurality of user of computing devices which communicate with a remote server via the Internet.

In one embodiment, multiple servers 102 may communicate with one another via one or more communication links. In this manner, multiple Player Interfaces at a first location may be associated with multiple Player Interfaces 20 at a second, remote location.

As described herein, the present disclosure provides for additional Applications, which may include games, to be used on the same Player Interface or display 24 of the Player Interface 20. The additional Applications may or may not be related to the primary game. The display 24 of the Player Interface is shared, with the additional Applications using all or a portion of the display 24 on any manufacturer's Player Interface.

Figure 3:
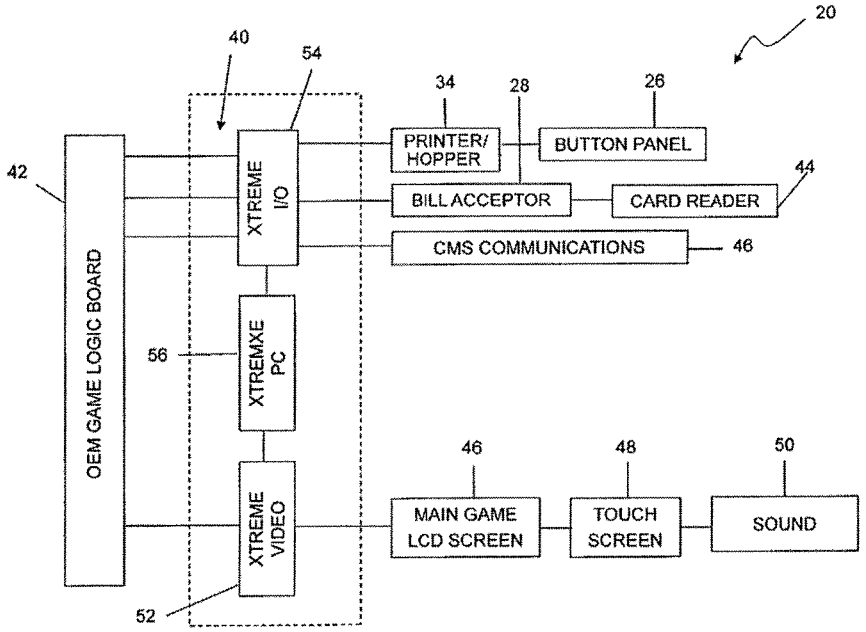
FIG. 3 illustrates a functional block diagram of a Player Interface in accordance with one embodiment of the invention; the block diagram includes representations of System 1 and System 2.

FIG. 3 shows a preferred embodiment, in which hardware, such as transaction or secondary controllers 40, can be incorporated or inserted into an existing Player Interface 20. The Player Interface 20 already incorporated an OEM Game Logic Board 42, a printer/hopper 34, a button panel 26, a bill acceptor 28, a card reader 44, a CMS communications connection 46, a Primary Game LCD Screen 24 (shown on FIG. 1 Player Interface 20), a Touch Screen 48, and speakers 50. Other devices and functionality can be included in the Player Interface as known by one having ordinary skill in the art. In the preferred embodiment, the transaction controller 40 is made up of one or more boards, in one embodiment the transaction controller includes a video board 52, a I/O board 54 and a controller 56. The video board 52 allows for the resizing of the display 24 on the Player Interface 20. The I/O Board 54 allows access to the printer/hopper 34, bill validator 30, and other equipment, and can also be configured to communicate with other systems, including a casino's back office system to report accounting meters and performance information. The PC Board 56 can connect any manufacturer's Player Interface 20 to a network 100, which will allow access to various Applications, such as the secondary games and applications (scratchers, pull tabs, lotto, Game-N-Game, Rewards, Main Event and Tournaments, drink ordering systems, show tickets, etc.) In the preferred embodiment, the transaction controller 40 may be configured as these three printed circuit boards 52, 54, 56 that can be inserted into an existing Player Interface or associated cabinetry without affecting the game play (except as described herein).

Figure 4:
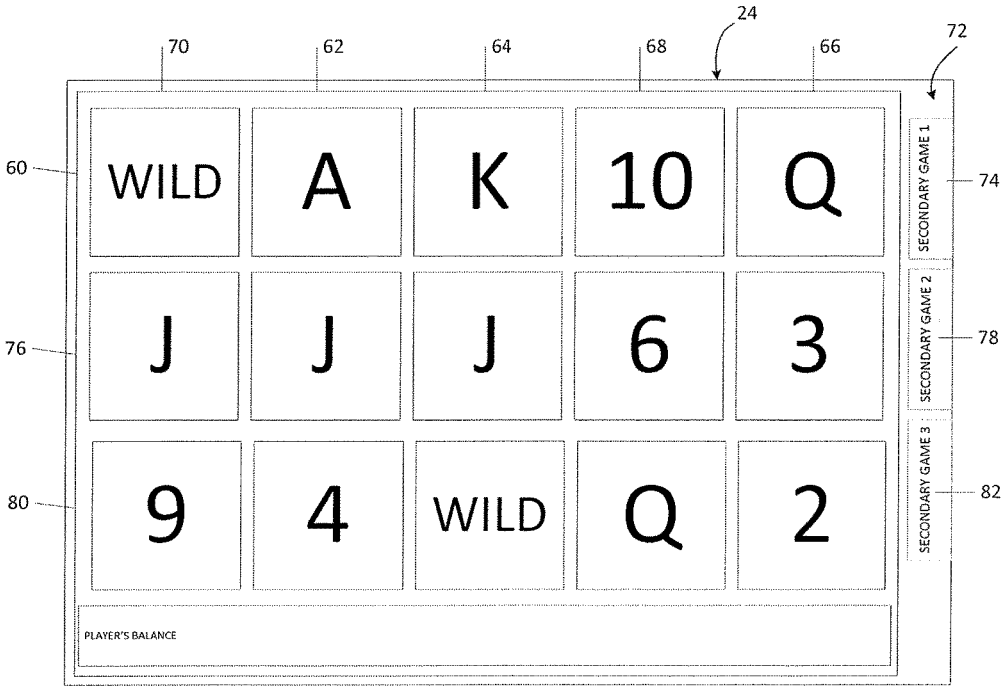
FIG. 4 illustrates the display of a gaming system in accordance with one embodiment of the invention; the gaming system including one or more Player Interfaces.

FIG. 4 shows an exemplary Player Interface or display 24 on a Player Interface 20 in accordance with the preferred embodiment of the present invention. As described above, when using the Player Interface 20, the player inserts money into the coin acceptor 28 or bill acceptor 30 into the Player Interface or uses a credit voucher or system to obtain credit to play games or use additional Applications. Usually, these types of games are Class III games as described herein. The display 24 shows, among other things, the symbols that are generated during game play to represent if the player has won on that play. For example, the top row 60 shows that the player has an ace 62, king 64, queen 66 and ten 68. The player has also has a wild symbol 70, with the result being a ten through ace straight winner.

In this case, the resulting play has a payout. On the right side 72 of the display 24 are the Class II games that can be played under certain circumstances (e.g. player purchases, win a play, win a promotional award, or otherwise be granted access to a game or service), such as when the player wins in that row 60. In the example, the player has won in the top row 60, and will get a chance to play a "secondary game 1" type game 74, thereby increasing the chances for the player to win; in this case in the "secondary game 1". In this example, the player has also won on the second row 76 and has won a play on "secondary game 3" type game 82. Finally, the player has not won on the third row 80.

Figure 5:
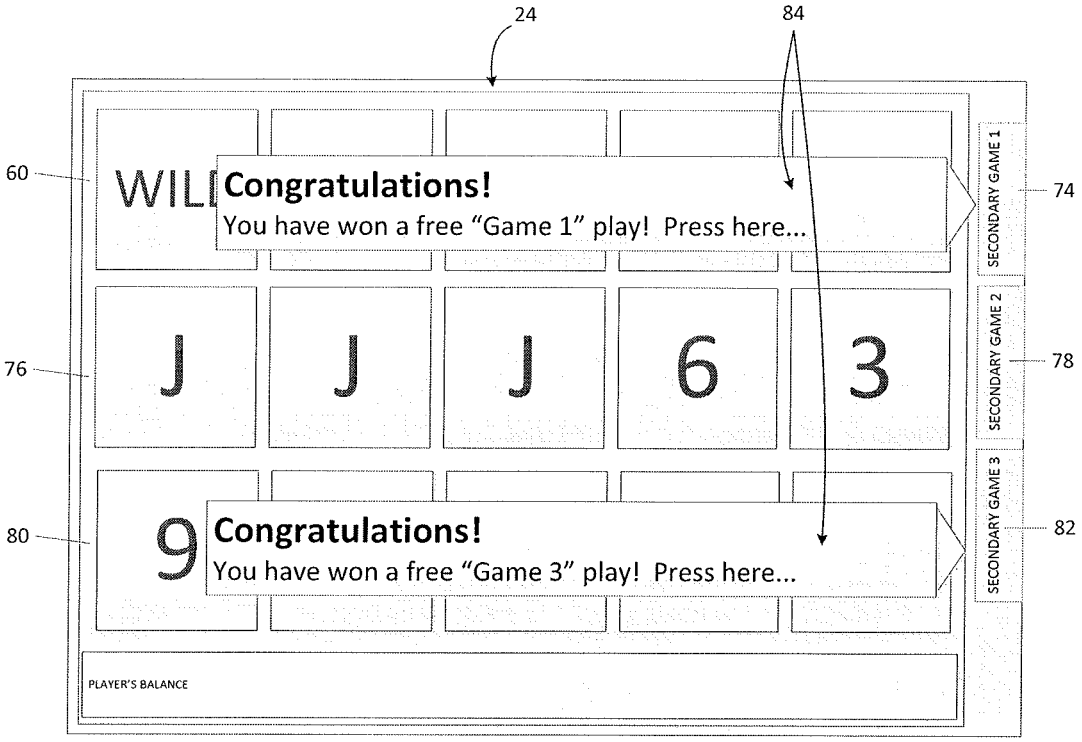
FIG. 5 illustrates the display of a gaming system in accordance with one embodiment of the invention; the gaming system including one or more Player Interfaces.

FIG. 5 shows the resulting display 24 shown to the player after the primary game is completed. The first row 60 has a winner and the player gets a play on secondary game 1 74. The second row 76 also has a winner and the player gets a play on secondary game 3 82. Finally, the third row 80 does not have a winner. The player can be informed of the winning combination through a banner 84 and/or an interactive avatar or some other branding display.

Figure 6:
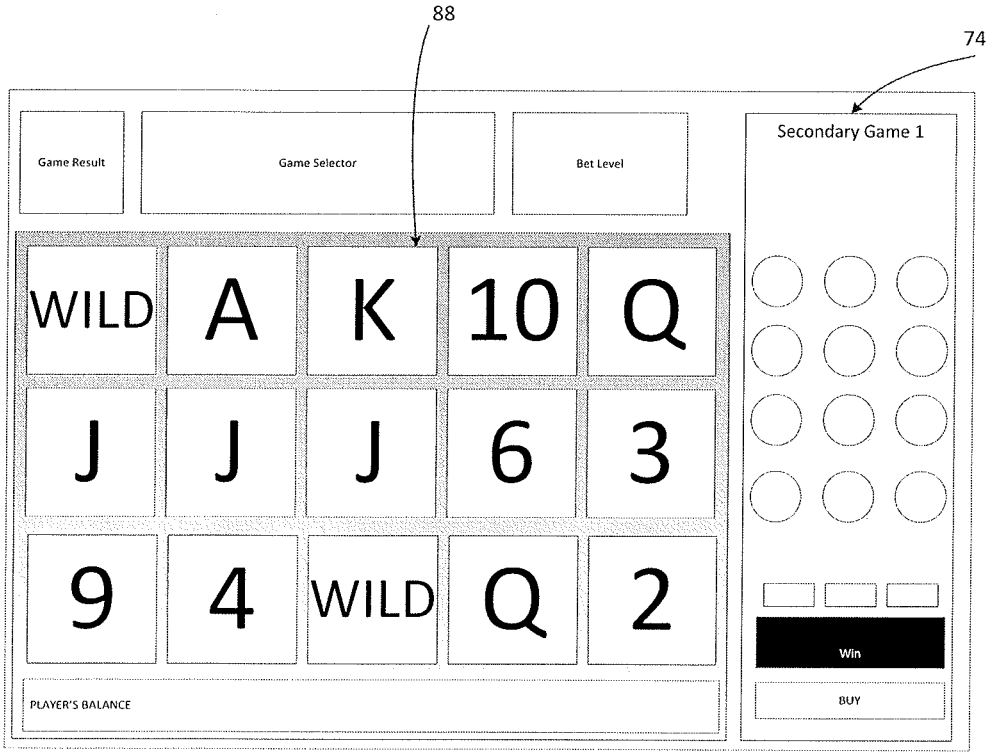
FIG. 6 illustrates the display of a gaming system in accordance with one embodiment of the invention; the gaming system including one or more Player Interfaces.

FIG. 6 shows the display 24 to the player when playing the secondary game 1 74. In displaying the secondary game 1 74, the original game 88 is reduced in size to make room for the secondary game 1 74 on the same display 24, which can be played as understood by one having ordinary skill in the art. Now the player can see the original game 88 (or continue playing the game 88), while also playing the secondary game 1 74. The display 24 can be reduced to make room for the secondary game, or the display can already be sized for the two (or more) games to run simultaneously.

Figure 7:
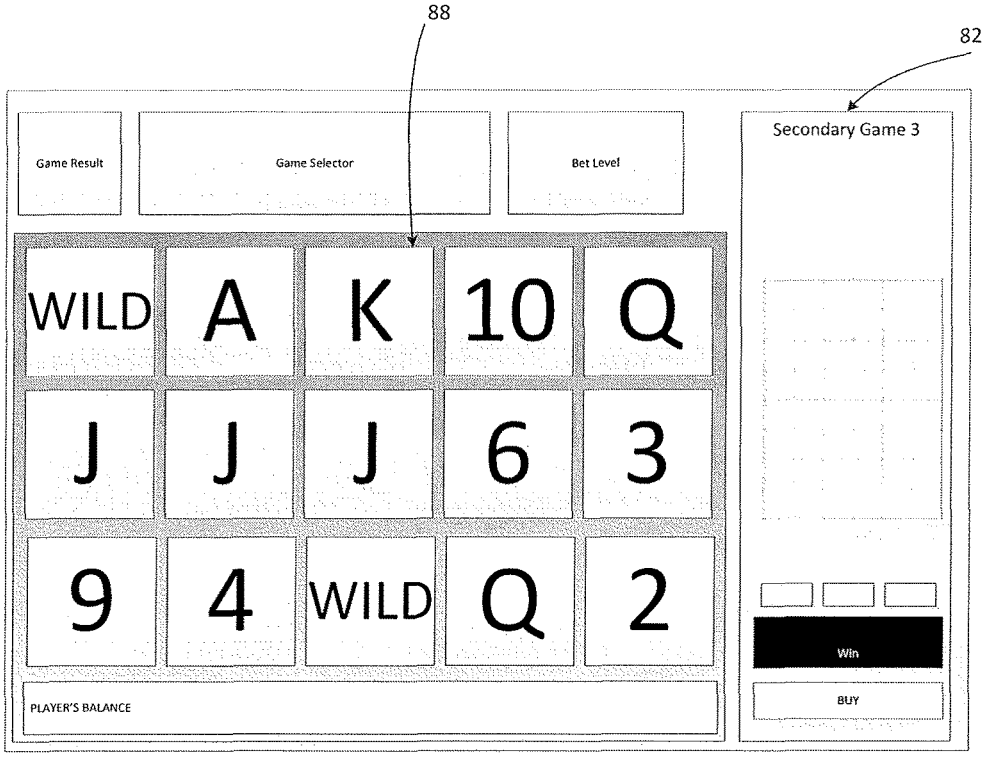
FIG. 7 illustrates the display of a gaming system in accordance with one embodiment of the invention; the gaming system including one or more Player Interfaces.

FIG. 7 shows the original game 88 reduced in size to make room for the secondary game 3 82. The player can play the primary game 88 and then play the secondary game 3 82 separately or simultaneously. Also, the display does not have to be divided between Class II and Class III games, as both games may be Class II or Class III. Further, there is no limit to how many games or Applications can be running simultaneously; two, as described, three or even more.

Figure 8:
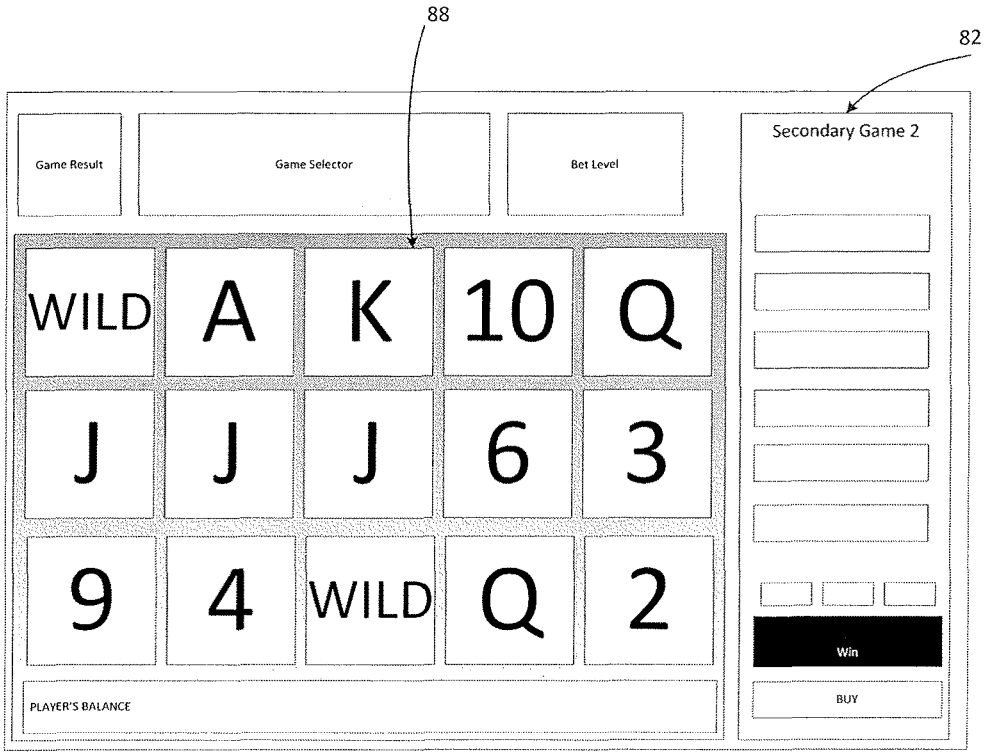
FIG. 8 illustrates the display of a gaming system in accordance with one embodiment of the invention; the gaming system including one or more Player Interfaces.

FIG. 8 shows the display 24 divided for the original game 88 and the secondary game 2 78, which though was not included in the above described wins of secondary games is still an available option for the player to play by purchase. As described above, in an embodiment of the present invention, the display 24 could be split into more sections, in this example (not shown), in which each of the games described 88, 74, 78, 82 (or others) alone or in combination, including other Applications, could be displayed to the player and played or used separately or simultaneously.

The present disclosure contemplates implementing the systems and methods described herein without additional hardware by incorporating hardware and/or software into the existing or new OEM design. Further, the apparatus, systems and methods described herein may also comprise a master balance that maintains one meter for the credits relating to the primary game and another meter for credits relating to the secondary game, allowing the player to have one credit balance displayed on the primary game, and use that same balance for purchasing secondary games and/or services.

The Transaction Manager 40 may also incorporate and control the master balance as described herein. The master balance is configured such that when a player inserts currency or a voucher into a bill acceptor or other credits on the Player Interface, the credits are added to the master balance. When the player wishes to play an additional game or use an additional Application as provided by the Transaction Manager, the credits from the master balance are transferred to game or Application, which is then used to complete the purchase of the game or service. If any credits are won or refunded during the additional game gameplay or service, the credits are transferred to the primary credit balance within the master balance protocol.

If any problems occur that prevent the Transaction Manager from transferring the credits to secondary game/service or back to the master balance the credits will be transferred upon resolution of the problem or may be paid by using an optional hand pay feature. The Transaction Manager allows the primary game to also update the master balance as it would normally update the credit balance and will acknowledge the state of the primary game to ensure transfer credits to and from the secondary game/service will be timed appropriately with other primary game activity.

The Transaction Manager follows certain protocols to properly credit and update the master balance and the escrow. The displayed player balance is the current balance available to the player, and is often displayed as credits (i.e. units), but may also be displayed at the monetary value of the credits. The display of the player balance is controlled by the primary game or as assigned by the Transaction Manager.

The present disclosure of the systems and methods described herein includes the Transaction Manager may process one or more transactions that include one or more purchases and/or wins simultaneously. When credits of varying types, such as cashable, promotional, etc., are present in the master balance, those credits will be used by the Transaction Manager in accordance with industry standards, which are well known. It is necessary for amounts in process by the Transaction Manager to be stored in non-volatile memory, to ensure the amount in process is not lost should the service managing process fail. Further, all credits available to the primary game will also be available to the additional games and Applications, such as promotional credits, restricted credits, etc.

For cashout purposes, credits cannot be cashed out while credits are in process by the Transaction Manager. Cashout can be completed when the Transaction Manager has completed processing all transactions.

As to the credit and win meter display updates, the primary game win display will not be updated for secondary game wins. The secondary game win display will not be updated for primary game wins.

Also, the protocol provides that the credit meter will be immediately decremented when credits are in the transfer process by the Transaction Manager for use in an additional game or Application purchase. The credit meter display will be incremented upon completion of the transfer to master balance.

For handpay events, if an award given by the additional game exceeds a predetermined handpay threshold, the additional game will lock for handpay and the credits will remain in process by the Transaction Manager until the handpay is cleared. The primary game will continue to function normally while the additional game is locked for handpay. Credits in process by the Transaction Manager will not be added to the master balance while the primary game is locked for handpay, and these credits will remain in process by the Transaction Manager until the handpay is cleared. If a handpay on the additional game is reset to meter, a commonly known process, the handpay credits in process by the Transaction Manager for that transaction will be transferred to the master balance.

While the disclosure is susceptible to various modifications and alternative forms, specific exemplary embodiments thereof have been shown by way of example in the drawings and have herein been described in detail. It should be understood, however, that there is no intent to limit the disclosure to the particular embodiments disclosed, but on the contrary, the intention is to cover all modifications, equivalents, and alternatives falling within the scope of the disclosure as defined by the following claims.

Various embodiments are described herein to various apparatuses, systems, and/or methods. Numerous specific details are set forth to provide a thorough understanding of the overall structure, function, manufacture, and use of the embodiments as described in the specification and illustrated in the accompanying drawings. It will be understood by those skilled in the art, however, that the embodiments may be practiced without such specific details.

In other instances, well-known operations, components, and elements have not been described in detail so as not to obscure the embodiments described in the specification. Those of ordinary skill in the art will understand that the embodiments described and illustrated herein are non-limiting examples, and thus it can be appreciated that the specific structural and functional details disclosed herein may be representative and do not necessarily limit the scope of the embodiments, the scope of which is defined solely by the appended claims.

Reference throughout the specification to "various embodiments," "some embodiments" "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment. Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional.

Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure. As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose.

Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

We claim:

1. A player interface, said player interface being configured to receive a value to be recorded as a credit in order to allow a player to use a first application and one or more secondary applications, the player interface comprising:

a gaming cabinet, said gaming cabinet housing a display interface, said display interface configured to display said first application and said secondary applications to said player, wherein said first application is independent from said secondary applications;

said display interface configured to resize the display of said first application and said secondary applications for simultaneous display to said player, wherein said first application is independent from said secondary applications;

a master balance, said master balance configured to maintain a balance for credits to allow said player to use said first application, said master balance further configured to fund and receive credits for said player's use of said secondary applications;

a transaction manager, said transaction manager configured to assign management of said master balance to said first application, such that said player can use said first application and said first application will increase or decrease said balance in said master balance based on the outcome of said first application, and said player can use said secondary applications and said transaction manager will increase or decrease said balance in said master balance based on the outcome of said secondary applications.

2. The player interface in accordance with claim 1, wherein said transaction manager is further configured to allow one of said first application and said secondary applications to own management of said master balance.

3. The player interface in accordance with claim 2, wherein the master balance is owned by the first application.

4. The player interface in accordance with claim 2, wherein ownership of the master balance can be assigned to a secondary application.

5. The player interface in accordance with claim 1, wherein said transaction manager is further configured to communicate to one or more related or independent systems a characteristics and other static data for said first application and for all said secondary applications.

6. The player interface in accordance with claim 5, wherein said characteristics and other static data comprise game name and configuration description.

7. The player interface in accordance with claim 5, wherein said characteristics and other static data comprises play options and location.

8. The player interface in accordance with claim 1, wherein said transaction manager is further configured to maintain separate accounting records for said first application and all said secondary applications.

9. The player interface in accordance with claim 8, wherein said transaction manager is further configured to communicate said separate accounting records for said first application and all said secondary applications to one or more related or independent systems.

10. The player interface in accordance with claim 8, wherein said transaction manager is further configured to communicate separate player and performance data records for said first application and for all said secondary applications to one or more related or independent systems.

11. The player interface in accordance with claim 8, wherein said transaction manager is further configured to communicate the separate accounting records for said first application and secondary applications to one or more related or independent accounting systems.

12. The player interface in accordance with claim 8, wherein said separate records of all activities for said first application and said second applications are transmitted through a network, including the Internet, to a server.

13. The player interface in accordance with claim 1, wherein said transaction manager is further configured to maintain aggregated accounting records for said first application and all said secondary applications.

14. The player interface in accordance with claim 13, wherein said transaction manager is further configured to communicate said aggregated accounting records for said first application and all said secondary applications to one or more related or independent systems.

15. The player interface in accordance with claim 13, wherein said transaction manager is further configured to communicate aggregated player and performance data records for said first application and for all said secondary applications to one or more related or independent systems.

16. The player interface in accordance with claim 13, wherein said transaction manager is further configured to communicate an aggregated data for said first application and secondary applications to one or more related or independent accounting systems.

17. The player interface in accordance with claim 1, wherein said transaction manager is further configured to transfer credit from said master balance when said player requests to use said secondary applications, wherein said master balance is reduced by said transfer credit amount and said transfer credit amount is used to allow said player to use said secondary applications.

18. The player interface in accordance with claim 17, wherein said transaction manager is further configured to transfer a winning credit amount, if any, to said master balance when said player has completed the use of said secondary applications, thereby increasing said master balance by said winning credit amount.

19. The player interface in accordance with claim 17, wherein said transaction manager is further configured to transfer refund credit amount, if any, to said master balance when said secondary applications rejects or does not respond to the credit transfer, thereby increasing said master balance by said refund credit amount.

20. The player interface in accordance with claim 1, wherein said first application is used to play a primary game.

21. The player interface in accordance with claim 20, wherein said primary game is a Class II or a Class III game.

22. The player interface in accordance with claim 1, wherein said secondary applications are used to play a secondary game.

23. The player interface in accordance with claim 22, wherein said secondary game is a Class II or a Class III game.

24. The player interface in accordance with claim 23, wherein said game is presented as one of a scratcher, pull tab, or lotto.

25. The player interface in accordance with claim 1, wherein one or more of said secondary applications facilitates the purchase of additional goods and services.

26. The player interface in accordance with claim 1, wherein said display interface is configured to display said first application and said secondary applications to said player simultaneously or upon player selection of said applications.

27. The player interface in accordance with claim 1, wherein the first application and secondary applications are managed by two or more independent systems.

28. The player interface in accordance with claim 1, wherein the first application and secondary applications are independent instances of the same application or different applications running on the same or related systems.

29. The method of using a first application and using a secondary application on a player interface in accordance with claim 1, in which the transaction manager allows the reporting of multiple independent systems to a management system as a single system.

30. The method of using a first application and using a secondary application on a player interface in accordance with claim 29, wherein transactions of each system are maintained and communicated separately and aggregated for purposes of consolidated reporting.

31. A method of using a first application and using one or more secondary applications on a player interface, said player interface comprising a gaming cabinet, said gaming cabinet housing a display interface, the method comprising the steps of:

a) receiving a value to be recorded as a credit in order to allow a player to use a first application and one or more secondary applications:

b) displaying on said display interface said first application;

c) accepting a request from said player to use one or more of said secondary applications, wherein said first application is independent from said secondary application;

d) using said transaction manager to control and maintain a master balance, said master balance configured to maintain a balance for credits to allow said player to use said first application, said master balance further configured to allow said player to use said one or more secondary applications;

e) using said transaction manager whereby said transaction manager has assigned control and maintenance of a master balance to said first application, said master balance configured to maintain a balance for credits to allow said player to use said first application, said master balance further configured to allow said player to use said one or more secondary applications; and f) using said transaction manager to communicate separate and aggregated accounting data to one or more related or independent accounting systems.

32. The method of using a first application and using a secondary application on a player interface in accordance with claim 31, wherein said transaction manager is further configured to control and maintain said master balance, such that said player can use said first application and said transaction manager will increase or decrease said balance in said master balance based on the outcome of said first application, and said player can use said secondary application and said transaction manager will increase or decrease said balance in said master balance based on the outcome of said secondary application.

33. The method of using a first application and using a secondary application on a player interface in accordance with claim 31, wherein said transaction manager is further configured to assign which application owns display of a single master balance credit to said player.

34. The method of using a first application and using a secondary application on a player interface in accordance with claim 31, wherein said transaction manager is further configured to assign control and maintenance of said master balance to said first application, such that said player can use said first application and said first application will increase or decrease said balance in said master balance based on the outcome of said first application, and said player can use said secondary application and said transaction manager will increase or decrease said balance in said master balance based on the outcome of said secondary application.

35. The method of using a first application and using a second application on a player interface in accordance with claim 31, wherein said transaction manager is further configured to maintain separate records of all master balance transactions for said first application and said secondary applications.

36. The method of using a first application and using a secondary application on a player interface in accordance with claim 35, wherein said separate records of all activities for said first application and said second application are transmitted through a network, including the Internet, to a server.

37. The method of using a first application and using a secondary application on a player interface in accordance with claim 31, wherein said transaction manager is further configured to transfer a credit amount from said master balance when said player requests to use said secondary application, wherein said master balance is reduced by said credit amount and said credit amount is used to allow said player to use said secondary application.

38. The method of using a first application and using a secondary application on a player interface in accordance with claim 37, wherein said transaction manager is further configured to transfer a winning credit amount, based on the outcome of said use of secondary application, to said master balance when said player has completed the use of said secondary application, thereby increasing said master balance by said winning transfer amount.

39. The method of using a first application and using a secondary application on a player interface in accordance with claim 37, wherein said transaction manager is further configured to transfer refund credit amount, if any, to said master balance when said secondary application rejects or does not respond to the credit transfer, thereby increasing said master balance by said refund credit amount.

40. The method of using a first application and using a secondary application on a player interface in accordance with claim 31, wherein said first application is a primary game.

41. The method of using a first application and using a secondary application on a player interface in accordance with claim 40, wherein said primary game is a Class II or Class III game.

42. The method of using a first application and using a secondary application on a player interface in accordance with claim 31, wherein said secondary application facilitates the purchase of additional goods and services.

43. The method of using a first application and using a secondary application on a player interface in accordance with claim 31, wherein said display interface is configured to display said first application and said secondary application to said player simultaneously or on player selection.

44. The method of using a first application and using a secondary application on a player interface in accordance with claim 31, wherein said secondary application is a secondary game.

45. The method of using a first application and using a secondary application on a player interface in accordance with claim 44, wherein said secondary game is a Class II or Class III game.

46. The method of using a first application and using a secondary application on a player interface in accordance with claim 45, wherein said game is presented as one of a scratcher, pull tab, or lotto.

* * * * *